US011692716B2

(12) United States Patent
Bayerlein et al.

(10) Patent No.: US 11,692,716 B2
(45) Date of Patent: Jul. 4, 2023

(54) HOUSING FOR HOUSEHOLD APPLIANCE WITH EXTERNAL PANEL HAVING INTEGRATED REINFORCEMENT

(71) Applicant: Electrolux Home Products, Inc., Charlotte, NC (US)

(72) Inventors: Stefan Bayerlein, Rothenburg ob der Tauber (DE); Stefan Dänzer, Rothenburg ob der Tauber (DE); Reinhold Hofmann, Rothenburg ob der Tauber (DE); Norbert Dänzer, Rothenburg ob der Tauber (DE)

(73) Assignee: Electrolux Home Products, Inc., Charlotte, NC (US)

( * ) Notice: Subject to any disclaimer, the term of this patent is extended or adjusted under 35 U.S.C. 154(b) by 371 days.

(21) Appl. No.: 16/874,869

(22) Filed: May 15, 2020

(65) Prior Publication Data

US 2021/0356137 A1 Nov. 18, 2021

(51) Int. Cl.

| | |
|---|---|
| ***F24C 15/06*** | (2006.01) |
| ***F24C 7/08*** | (2006.01) |
| ***F24C 15/08*** | (2006.01) |

(52) U.S. Cl.

CPC ..... *F24C 15/06* (2013.01); *F24C 7/08* (2013.01); *F24C 15/08* (2013.01)

(58) Field of Classification Search

CPC ..... F24C 15/06; F24C 7/08; F24C 15/08

See application file for complete search history.

(56) References Cited

U.S. PATENT DOCUMENTS

| | | | |
|---|---|---|---|
| 1,810,842 | A | 6/1931 | Moecker, Jr. |
| 2,266,881 | A | 12/1941 | Lindemann |
| 2,357,025 | A | 8/1944 | Sandberg |
| 2,418,152 | A | 4/1947 | Avery |
| 2,675,797 | A | 4/1954 | Reeves |
| 2,705,947 | A | 4/1955 | Pearce |

(Continued)

FOREIGN PATENT DOCUMENTS

| | | | |
|---|---|---|---|
| KR | 960003106 | 4/1996 | |
| WO | WO-2010075938 A1 * | 7/2010 | ..... A47B 47/03 |

OTHER PUBLICATIONS

Panel-Bodyside. Frigidaire. URL: http://www.appliancepartspros.com/frigidaire-panel-bodyside-316400116s-ap3950954.html. 3 pages.

*Primary Examiner* — Alfred Basichas

(74) *Attorney, Agent, or Firm* — Pearne & Gordon LLP

(57) ABSTRACT

A household appliance is provided having a plurality of decorative external panels that provide reinforcement to and an exterior face of the appliance. At least one of the panels has a main body portion and an interior body portion integrally formed together from a common sheet of material. The interior body portion has a plurality of integral structural reinforcements formed from bending the sheet of material in the interior body portion adjacent the main body portion. The integral structural reinforcements can include a pair of opposed parallelly extending pillars each defining a columnar volume, and a pair of opposed rearwardly bent flanges each being bent to engage the pair of pillars to form a box frame adjacent to and integral with the main body portion. In preferred embodiments, the plurality of reinforced external panels together can define a chassis of the appliance.

20 Claims, 11 Drawing Sheets

(56) References Cited

U.S. PATENT DOCUMENTS

| | | | |
|---|---|---|---|
| 3,213,847 | A | 10/1965 | Scott |
| 3,370,521 | A | 2/1968 | Honerkamp |
| 3,925,948 | A | 12/1975 | Sauer et al. |
| 3,934,805 | A | 1/1976 | Elaschuk |
| 4,563,559 | A | 1/1986 | Enami |
| 6,382,748 | B1 | 5/2002 | Flamme et al. |
| 7,012,230 | B2 | 3/2006 | Kim et al. |
| 7,293,847 | B2 | 11/2007 | Lee et al. |
| 7,533,666 | B2 | 5/2009 | Hosoi et al. |
| 9,211,050 | B2 | 12/2015 | Fetzer et al. |
| 2009/0113846 | A1 | 5/2009 | Knauf |
| 2009/0194089 | A1 | 8/2009 | Durney |
| 2010/0154462 | A1 | 6/2010 | Arzoz Barandalla |
| 2016/0051123 | A1 | 2/2016 | Gleixner |

* cited by examiner

HOUSING FOR HOUSEHOLD APPLIANCE WITH EXTERNAL PANEL HAVING INTEGRATED REINFORCEMENT

FIELD OF THE INVENTION

The present disclosure is directed to structural reinforcement of a household appliance, and more specifically to structural reinforcement of a food cooking apparatus, such as having a reinforced-decorative external panel.

BACKGROUND

Conventionally, household appliances include an interior frame or chassis supporting functional elements and providing a general shape of the appliance. The frame or chassis can be supported where suitable, such as by internal bracing. Decorative external body panels are attached to the frame or chassis to enclose the functional elements and provide the resultant outer appearance and footprint for the appliance. The external panels typically provide little or no structural support to the appliance, but instead are merely provided according to a desired aesthetic appearance.

BRIEF SUMMARY

According to an aspect, a household appliance includes a chassis and a decorative external panel providing reinforcement to said appliance. The decorative external panel comprises a main body portion and an interior body portion integrally formed together from a common sheet of material. The interior body portion comprises a first integral structural reinforcement formed from bending said sheet of material in said interior body portion.

According to another aspect, a decorative external panel at least partially defines a chassis of a household appliance and includes a main body portion and an interior body portion integrally formed together from a common sheet of material. The interior body portion comprises a first integral structural reinforcement formed from bending said sheet of material in said interior body portion to provide reinforcement to said appliance.

According to yet another aspect, a decorative external panel for a household appliance includes a main body portion and an interior body portion integrally formed together from a common sheet of material. The interior body portion comprises a plurality of integral structural reinforcements formed from bending said sheet of material in said interior body portion to provide reinforcement to said appliance. The plurality of integral structural reinforcements together form a box frame of integral structural reinforcement adjacent to and integral with the main body portion. The box frame defines a plurality of respective columnar volumes of the plurality of integral structural reinforcements.

The foregoing and other features of the invention are hereinafter described in greater detail with reference to the accompany drawings.

BRIEF DESCRIPTION OF THE DRAWINGS

The accompanying drawings, which are not necessarily to scale, show various aspects of the disclosure.

DETAILED DESCRIPTION

The present disclosure relates to a three-dimensional structure having an external appearance at least partially provided by an external panel having integrated structural reinforcement. The three-dimensional structure includes a chassis to which the external panel is affixed. Use of the external panel having integrated reinforcement provides benefits compared to use of a conventional external panel lacking integrated reinforcement and attached to intervening support bracing disposed between the conventional external panel and a chassis. The external panel having integrated reinforcement provides a more efficient assembly process and, when attached to the chassis, provides one or more of increased torsional rigidity, edge and corner rigidity, support against compression, and impact deflection as compared to conventional external panels lacking integrated reinforcement.

The three-dimensional structure can be a part of an appliance, such as a commercial or household appliance. For example, a kitchen appliance such as a cooking appliance can include the three-dimensional structure. In other embodiments, the three-dimensional structure could be included in a dish washing appliance or clothes washing appliance, for example, among others.

Figure 1:
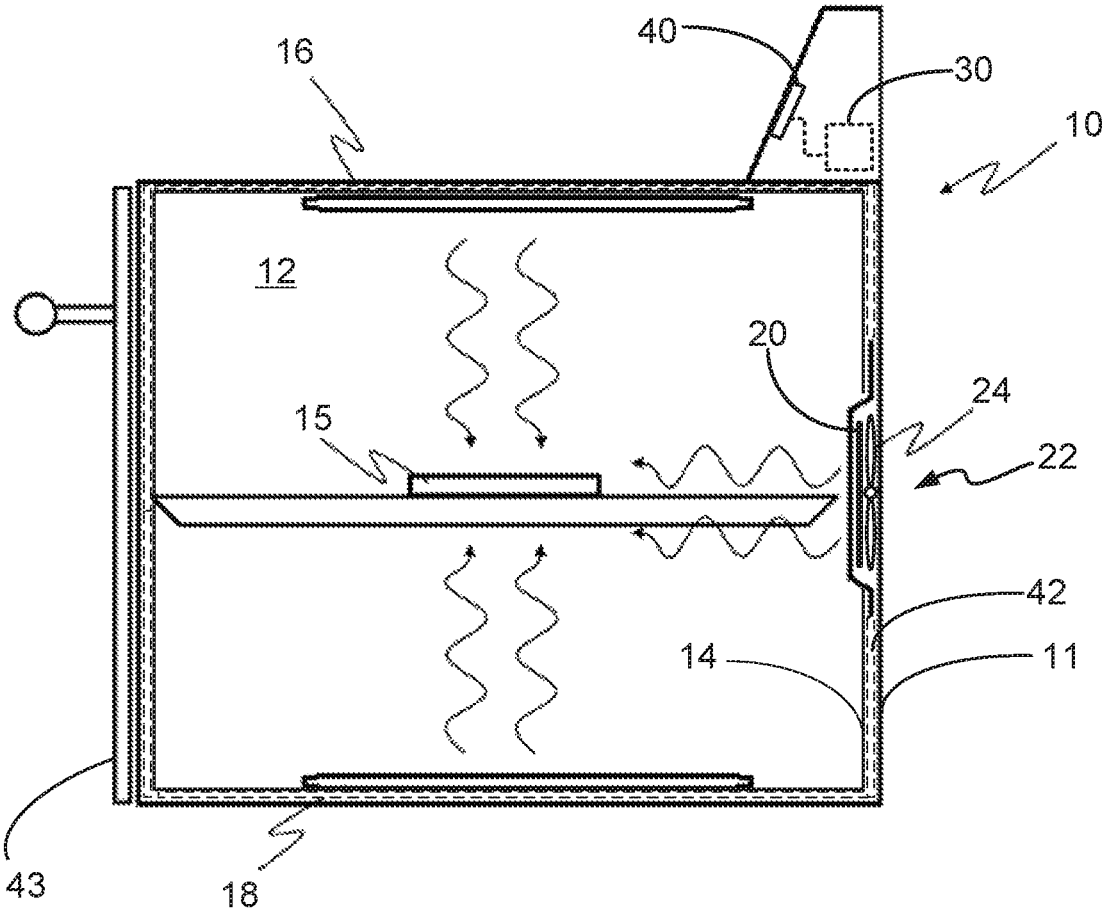
FIG. 1 schematically illustrates a side cross-section of a cooking appliance that can include an external panel having integrated reinforcement.

Turning now to FIG. 1, a cooking appliance 10, such as a kitchen range, is illustrated having a fan and heating elements for heating an interior oven cavity 12 defined by an oven muffle 14. The muffle 14 is mounted to and supported by an appliance chassis 42 as known in the art. The appliance chassis can support a decorative external body 11 which can be at least partially comprised of the decorative external panels as disclosed herein, which panels can be mounted to the chassis 42 to provide the appliance's outward appearance. Alternatively, in a preferred embodiment the decorative external body 11 supplied by the external panels as herein disclosed itself constitutes the appliance chassis 42, owing to integrated reinforcement features of those panels as will be described. A food item 15 to be cooked is illustrated within the oven cavity 12. The heating elements for heating the oven cavity 12 and cooking the food item 15 can include one or more of a broil heating element 16, a bake heating element 18, and a convection heating element 20. The broil heating element 16 is disposed at (i.e., in or adjacent) an upper portion of the oven cavity 12. The bake heating element 18 is disposed at (i.e., in or adjacent) a lower portion of the oven cavity 12, generally opposite the broil heat element 16. The convection heating element 20 is disposed at (i.e., in or adjacent) a back portion of the oven cavity 12.

The convection heating element 20 is part of a convection heating system 22 including the convection heating element 20 and an associated motive element for moving heated air, such as the convection fan 24.

One or more additional heating elements or fans can be provided in other embodiments, and/or one or more of them can be omitted.

Figure 2:
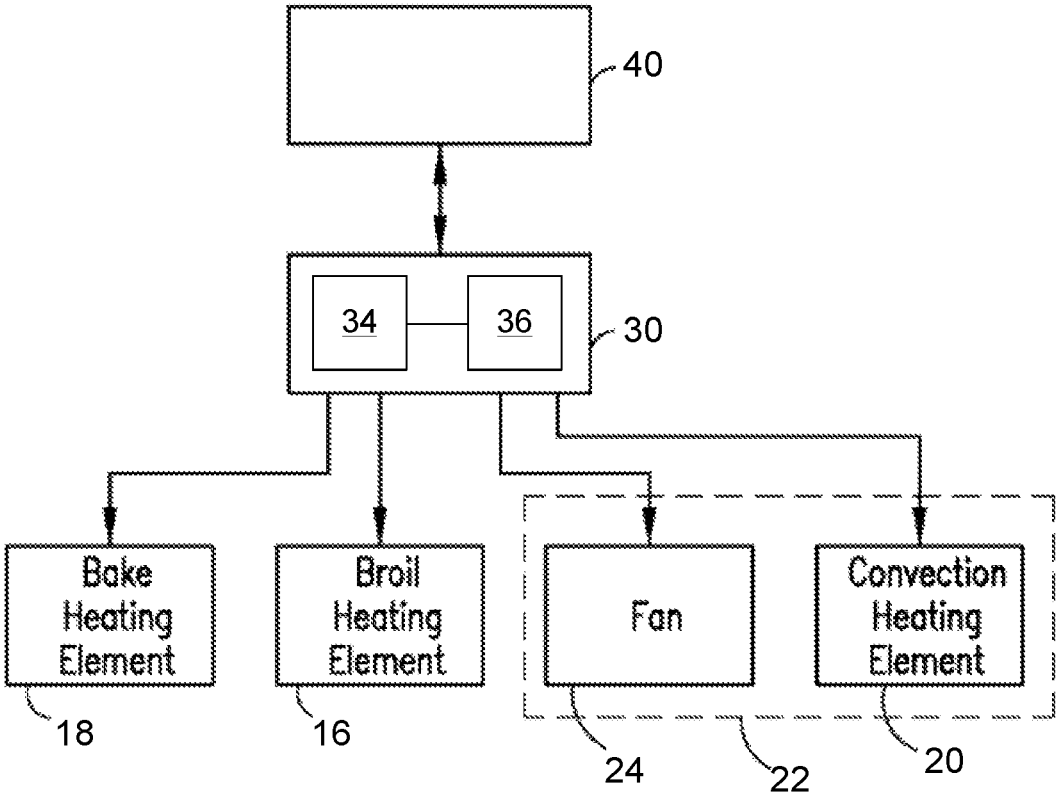
FIG. 2 schematically illustrates a control system of the cooking appliance of FIG. 1.

The cooking appliance 10 includes a control system 30, which while illustrated at an upper-rear location of the appliance 10 can be otherwise suitably located in other embodiments. The control system 30 is schematically illustrated at FIG. 2 and is provided for controlling operation of the heating elements 16, 18, and 20 and of the fan 24. As will be understood by one having ordinary skill in the art, the control system 30 of the cooking appliance 10 can be configured to operate any one of the heating elements 16, 18 and 20 and the fan 24 separately from one another or in conjunction with any one or more of the other of the heating elements 16, 18 and 20 and the fan 24. The control system 30 includes at least a processor 34 and a storage 36, such as a memory, which in other embodiments can be integral with the processor 34. A user can control aspects of the cooking appliance 10 via a user interface 40 communicatively coupled to the control system 30.

Figure 3:
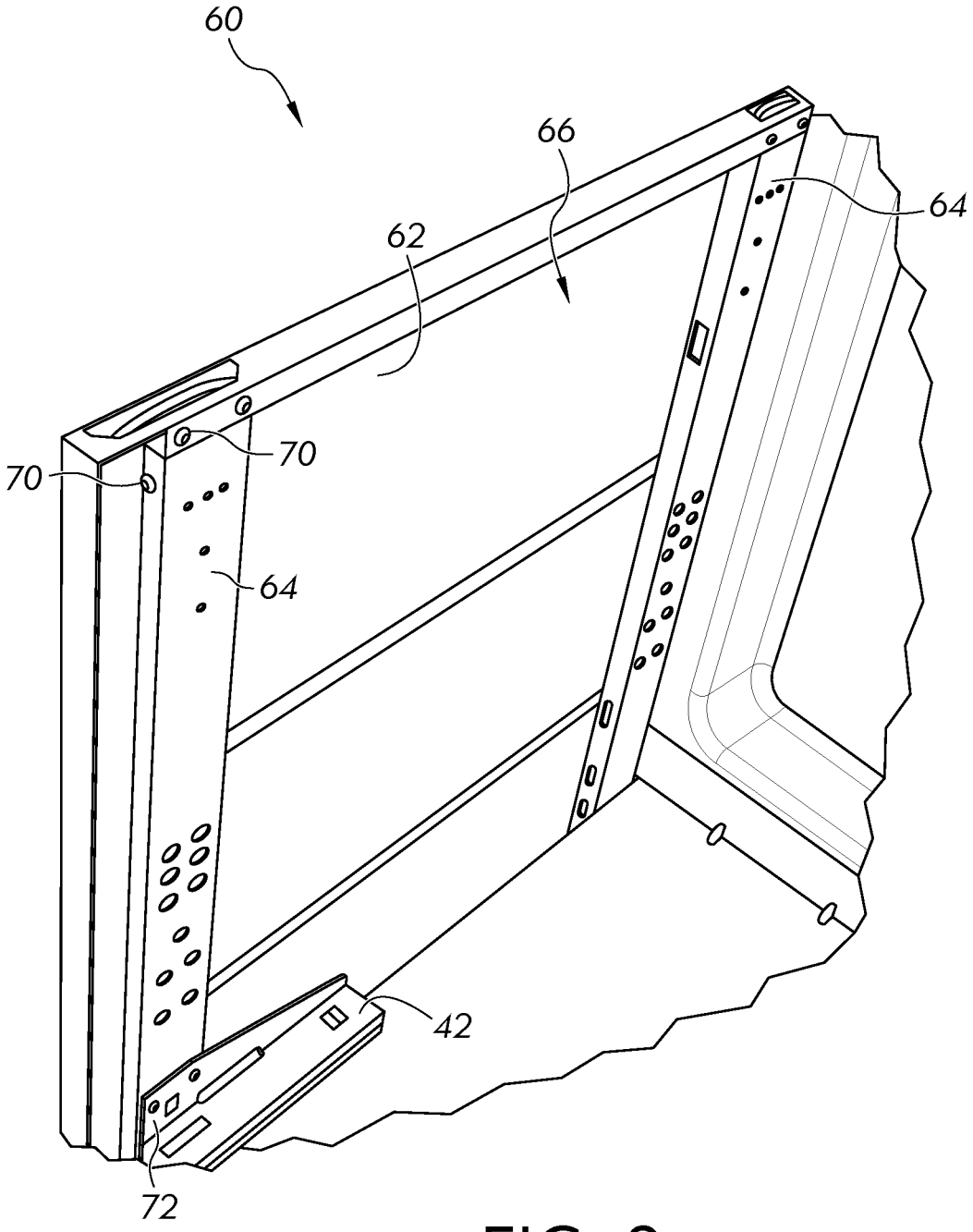
FIG. 3 (PRIOR ART)
FIG. 3 illustrates an external panel of the prior art, which lacks integrated reinforcement and relies instead on fastened separate columns.

Turning briefly to FIG. 3, a conventional decorative panel which can be used with the cooking appliance 10 to provide an outward appearance is illustrated at 60. This external panel 60 includes a main body portion 62 having at least one structural reinforcement 64 attached thereto. The main body portion 62 is not unitary or integrally formed with structural reinforcement 64. Instead, the structural reinforcement 64 is separately formed and then fastened to an inner side 66 of the main body portion 62 by fasteners 70, such as screws or rivets. The structural reinforcement 64 includes intervening members, such as brackets 72, that are affixed between the panel 60 and the chassis 42. Because the intervening members 72 in such conventional constructions are coupled to the structural reinforcement 64 (of panel 60) and to the chassis 42 via respective sets of fasteners at each end, this construction provides reduced structural support due to the multiple points of attachment at opposing ends of the bracket 72. In addition to higher part-count, this results in lower torsional rigidity, lower impact deflection and lesser support against compression.

Turning now to FIG. 4, structure of the cooking appliance 10 is shown in additional detail, but with an alternative decorative external panel 46 according to the present application. Aspects of the cooking appliance 10, such as external top structure, are removed to better show other structural aspects of the cooking appliance 10 lying underneath. For example, the hob and other upper appliance structure that would normally be in-place have been removed in order to better visualize structural features at an inner side 50 of the external panel 46.

Figure 4A:
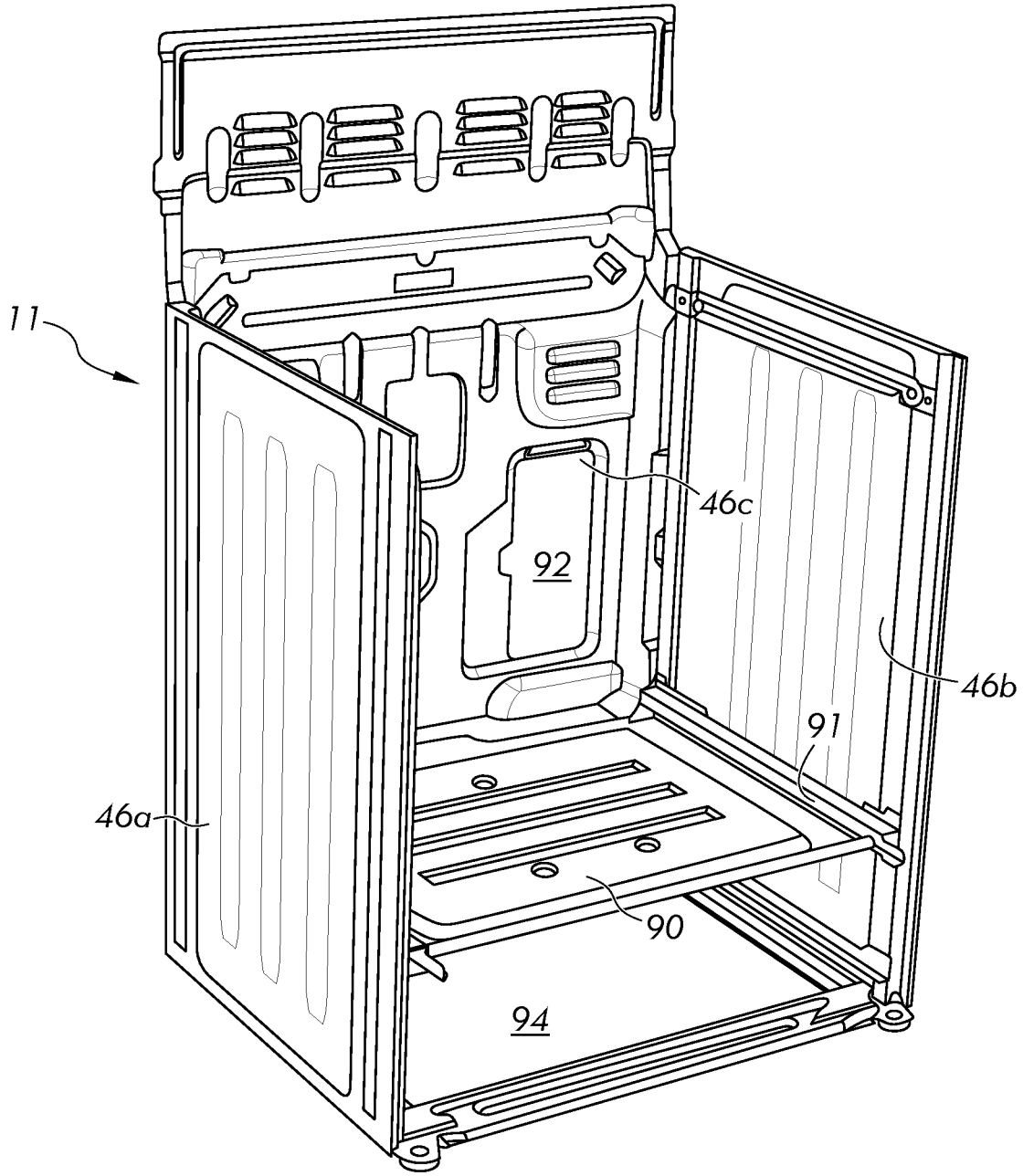
FIG. 4A illustrates a perspective view of the cooking appliance of FIG. 1, with portions removed, wherein the appliance chassis is defined by reinforced external panels as herein disclosed, according to a first embodiment.
Figure 4B:
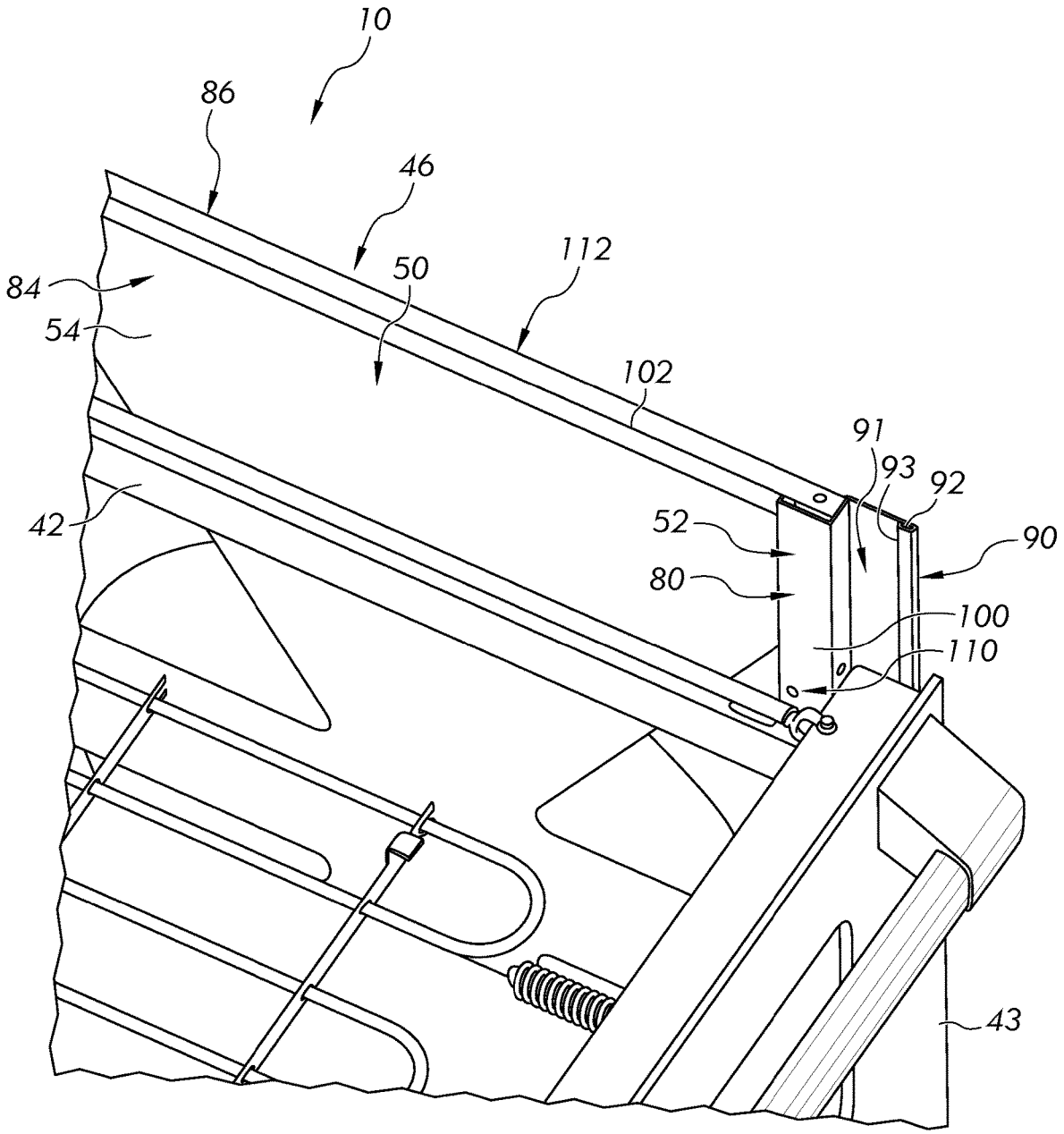
FIG. 4B illustrates a partial top perspective view of the cooking appliance of FIG. 1, with portions removed, wherein a reinforced external panel as herein disclosed is affixed to a chassis element of the cooking appliance, according to an alternative embodiment.
Figure 5A:
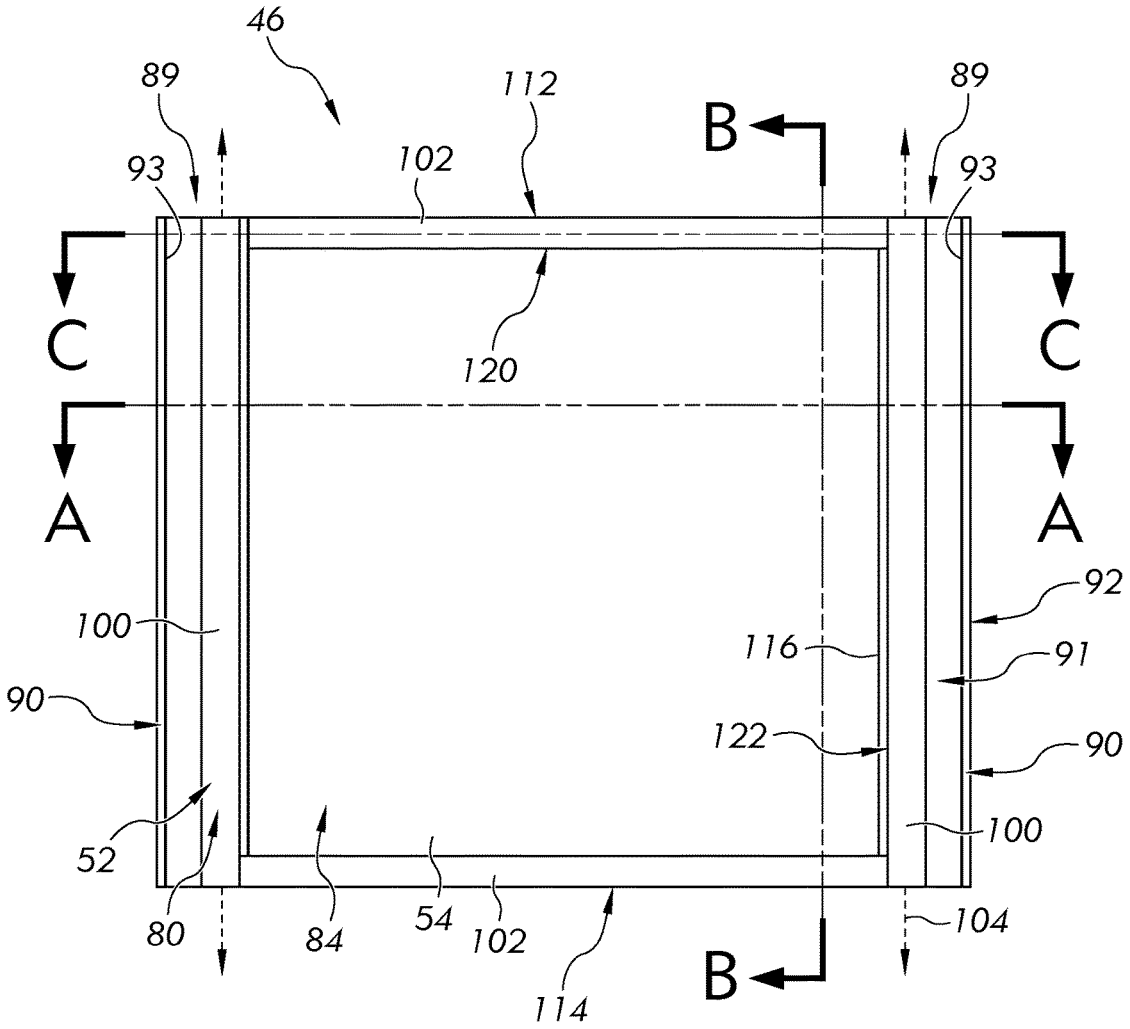
FIG. 5A illustrates an interior view of an external panel with integrated reinforcement as herein described.

As shown at both FIGS. 4B and 5A, the external panel 46 as disclosed herein is a unitary component formed of a single sheet of material (preferably metal) that integrates reinforcing features with a main panel body in a unitary construction. The sheet can be made of any suitable metal, such as aluminum, which can have one or more coatings applied thereto, such as paint or other protective coatings applied to either the outer side or inner side, or both.

Generally, as shown in FIG. 4A a household appliance can be provided such that a plurality of external panels 46 as herein described are assembled together to form a self-reinforced chassis 42 of the appliance, essentially in the form of a box-frame defined by fastened-together left- and right-side and rear external panels 46 having integral structural reinforcement 52 as herein described. In this manner, the decorative external panels 46 themselves define the appliance chassis 42, to which other internal elements can be secured during assembly. For example, as seen in FIG. 4A a divider 90 can be supported between the opposing side external panels 46*a*,46*b* in order to divide the interior chassis space between an oven-cavity section 92 and a storage-drawer section 94. The divider 90 also can provide lateral support to the opposing side external panels 46*a*,46*b*, helping to fix their spacing from one another forward of the rear external panel 46*c*. When installed, the oven muffle 14 that defines cooking cavity 12, a cooking hob (not shown) and oven door 43 (see FIG. 1) also will be affixed to chassis 42 defined by the assembled external panels 46 as shown in FIG. 4A. The integral structural reinforcement 52 in such panels 46 ensures robust structural integrity to the panels such that they can be assembled to constitute the appliance chassis without additional interior support beams and braces, or a separate internal chassis frame made from such parts. This is particularly advantageous because the chassis itself is reduced largely to the decorative, external panels of the appliance, without the need to incorporate internal reinforcement.

Alternatively, in a less preferred embodiment shown in FIG. 4B, the external panels 46 can be engaged and coupled to one or more internal chassis-support elements 42 (see FIG. 4) such as an internal beam or brace of a chassis frame. In this embodiment, the panel 46 can be mounted directly to the chassis support element 42, e.g. via integral structural reinforcement 52, preferably absent intervening structural members such as separately formed and fastened-in brackets, bars, beams, load bearing panels, etc.

To prepare an external panel 46 as contemplated herein, a single sheet of material (preferably metal) is bent back over on itself against or adjacent an inner side of the sheet at one or more locations of that panel 46 that define terminal upper and lower ends/edges 112, 114 and terminal lateral side ends/edges 90 of that panel 46. Additional bends introduced into the sheet metal behind the main body portion 54 collectively define an interior body portion 80 of the panel 46, and introduce additional shapes and structures that provide both reinforcement and affixation structure for attaching the panel 46 directly to adjacent such panels 46 to define a chassis 42, or to underlying chassis support elements 42 in embodiments where present. In this application, all such structures of the panel 46 introduced behind the main body portion 54 via bends in the panel 46 can be referred to as integral structural reinforcement 52 formed in an interior body portion 80 of the panel 46 (as opposed to the main body portion 54 of the panel 46). All structural reinforcing features of the integral structural reinforcement 52 (to be described) are formed integral with one another in and as part of the interior body portion 80, which also provides affixation structure to secure the panel 46 to adjacent panels 46 or to other chassis support elements 42 without intervening brackets, as will be described. Fasteners extending through the main body portion 54 to attach the interior body portion 80 thereto are not necessary and are avoided.

That is, a main body portion 54 and features of the structural reinforcement 52 are integrally formed together. The features making up the structural reinforcement 52 are formed from bending terminal ends of the sheet backward against an inner side 50 of the sheet (i.e. inner side 84 of the main body portion), thus forming said reinforcement features which are integral with one another and with the main body portion 54 of the panel 46. The bent portions forming the structural reinforcement 52 contribute rigidity and stiffness to that panel 46, thus increasing the overall structural robustness of the assembled appliance against transient external loads as may be encountered during transport.

The main body portion 54 has an outer side 86 visible from the outside, and opposite the inner side 84 seen in FIGS. 4B and 5A, which faces inward of the appliance 10. The outer side 86 provides an external decorative surface of the appliance 10 and can be seamless to provide a generally flush or smooth appearance. This is due to the integral structural reinforcement 52 allowing omission of fasteners through the main body portion 54 to engage the panels 46 to one another or to separate underlying chassis support elements 42 if present, or as might otherwise have been required to affix a separately-applied reinforcement to the inner side 84 of the panel 46.

As shown, the structural reinforcement 52 features disposed at the inner side 50 of the panel 46 are formed from bends that proceed over less than a full extent of the inner side 84 of the main body portion 54. In other embodiments, structural reinforcement 52 features can extend more fully across the inner side 84 of the main body portion 54.

Turning now to the features of the structural reinforcement 52, said reinforcement features are formed of the same single sheet as the main body portion 54, in and defining the interior body portion 80 thereof. Particularly, as generally noted above, the structural reinforcement 52 comprises oppositely folded side portions 89 (FIG. 5A), which have been folded rearwardly and generally towards a center of the inner side 84 of the main body portion 54, such as to overlay the inner side 84. As used herein, aspects overlaying one another may or may not be in direct contact with one another. The side portions 89 generally overlay the main body portion 54 in order to provide a relative flat structure of the panel 46 adjacent both its lateral edges, prior to reaching structural reinforcement features formed of bends that result in the structural reinforcement 52 protruding away from the main body portion 54, at locations directed more toward the center of the panel 46.

As shown at FIG. 5A, the sheet forming the panel 46 can be fully bent rearward over its full vertical extent or height at or adjacent the lateral side ends thereof forming opposed continuous bends 92. Each noted bend 92 generally forms a U-shaped configuration of folded metal defining and at the respective side edge 90 of the panel 46, wherein the edge 90 is formed at and as the apex of the 'U.' Additional integral structural reinforcement 52 features can be incorporated into the sheet metal, e.g. via additional bends, in the interior body portion 80 remote and recessed inward from the bends 92 defining the edges 90. Such additional structural reinforcement 52, together with and as part of the interior body portion 80 of the panel 46, is integrated together with the main body portion 54 of the panel, integrally affixed thereto via the bends 92 which join the main body and interior body portions 54 and 80. This is contrary to conventional structures, wherein individual reinforcement features are attached to a main body portion of an external panel at discrete fastening locations as in the conventional panel 60 illustrated at FIG. 3. Moreover, due to the bends 92, the lateral side edges 90 of the external panel 46 lack free-floating distal peripheral sheet-metal edges, which otherwise could be easily impacted and more easily damaged during manufacturing, shipment, transport, installation, etc. In some embodiments, one or both of the lateral-edge bends 92 can be discontinuous and extend less then fully along the full height of the panel 46 at its respective lateral side edges 90.

It will be appreciated that the terms lateral, upper, lower, horizontal, vertical, inner and outer are used with respect to the orientation of the illustrations in the figures and that the panel 46 can be otherwise aligned for use, where suitable. For example, the lateral edges 90 can be reconfigured as opposed upper and lower edges in some embodiments.

Figure 5B:
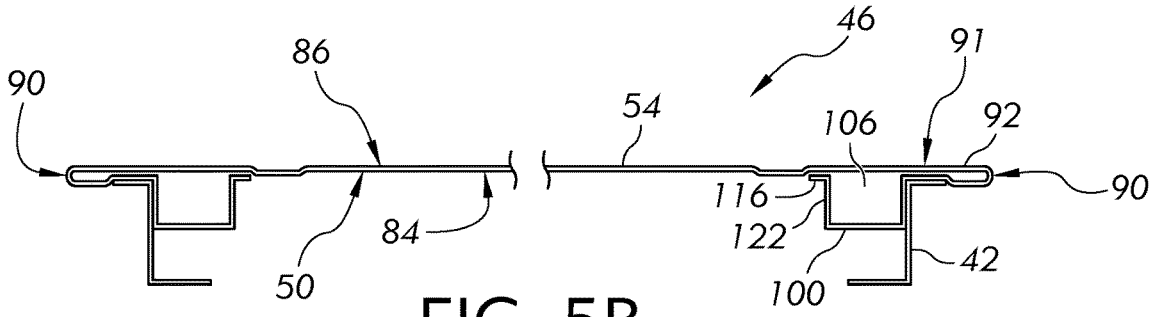
FIG. 5B illustrates a cross-sectional view of the external panel of FIG. 5A, shown at a line A-A of FIG. 5A and disposed adjacent a portion of the chassis.
Figure 6A:
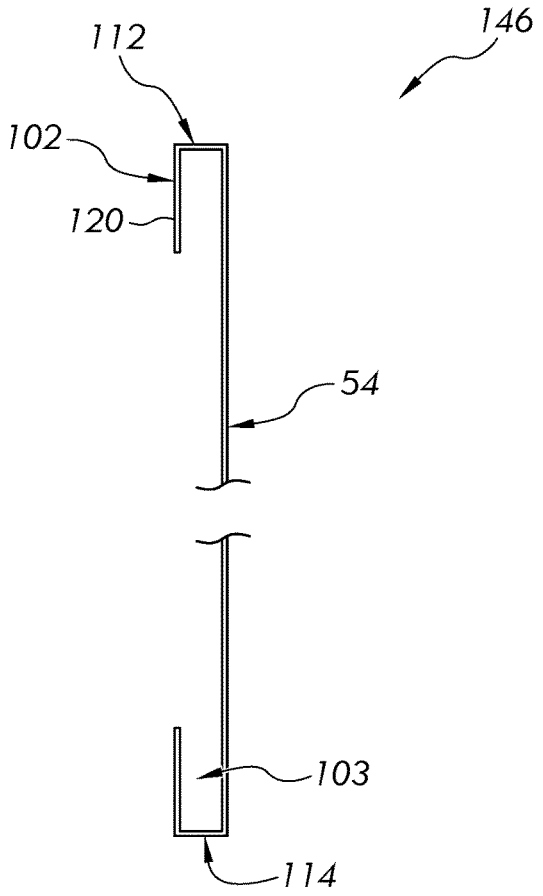
FIG. 6A illustrates a cross-sectional view of the external panel of FIG. 5A, shown at a line B-B of FIG. 5A.

Turning now additionally to FIGS. 5B and 6A, example structural reinforcements 52 are described in detail. Notably, FIG. 5B illustrates a horizontal cross-section of the panel 46 in FIG. 5A, with FIG. 6A illustrating a vertical cross-section of that panel 46.

First, inwardly of the bends 92, the illustrated external panel 46 includes a pair of opposed multi-layer thick lateral regions 91 having a plurality of layers of the external sheet 46 laid against one another. That is, the resulting dual-layer (or optionally multi-layer—e.g. if multiple accordion-style layers are folded over one-to-the-next) regions adjacent edges 90 provide additional robustness and structural (e.g. torsional and bending) rigidity to the panel 46; and thus to the entire appliance 10 when assembled thereto. Each such multi-layer thick region 91 preferably extends along a majority of the adjacent lateral edge 90, and preferably along the full extent thereof. Further, the multi-layer thick lateral regions 91 can have equal horizontal extents compared to one another, extending horizontally/laterally the same distance from the adjacent lateral edge 90 to a respective pillar 100.

Each multi-layer thick region 91 further includes a crimp line 93 that extends vertically and is defined by crimping the multi-layer thick region 91 so that portions thereof formed from the interior body portion 80 are compressed against the inner side 84 of the main body portion 54. The crimp lines 93 are disposed laterally inward of each the respective lateral edges 90, and extend longitudinally along the main body portion 54 in a direction generally parallel to those edges 90. The pair of opposed crimp lines 93 adds further structural support and torsional rigidity to the external panel 46.

In other embodiments, fewer or more crimp lines 93 can be included, or they can be omitted. Further still, crimp lines 93 can extend transverse or non-parallel to one another or to the respective pillars 100 or edges 90. They also need not necessarily be linear in every instance. In some embodiments one or both of the multi-layer thick regions 91 can have other than equal horizontal dimensions.

Referring still to FIGS. 4, 5A, 5B and 6A, the interior body portion 80 includes additional integral structural reinforcement 52 in the form of at least one vertical pillar 100 and at least one horizontal bent flange 102. As depicted, the external panel 46 includes at least a pair of opposed pillars 100 adjacent the respective lateral edges 90 of the panel 46, although any suitable number can be formed in the interior body portion 80 from the single sheet of the external panel 46.

Each pillar 100 is integrally formed with and as part of interior body portion 80. In the illustrated embodiment, each pillar 100 extends generally vertically adjacent to a side edge 90 of the external panel 46 and has a respective central axis 104 (FIG. 5A) that extends longitudinally vertically along the main body portion 54, which axis 104 is laterally inwardly spaced from a respective side edge 90.

Each of the illustrated pillars 100 extends generally parallel to a longitudinal extension direction of the respective lateral edges 90 and transverse, such as generally orthogonal to, vertical top and bottom edges 112 and 114 of the external panel 46. Further, each pillar 100 extends fully between the top edge 112 to the bottom edge 114.

In some embodiments, one or more pillars can extend other than parallel to one another and/or in other directions, and need not necessarily be disposed adjacent to the respective lateral edges 90 of the panel 46 and/or one or more of the pillars 100 can be disposed laterally-outwardly closer to the respective adjacent lateral edge 90 of the external panel 46 than the other of the pillars 100. In some embodiments, one or more pillars can extend less than fully between the top and bottom edges 112 and 114.

One or more holes 110 (FIG. 4B) can be provided through one or more sides of each pillar 100 to allow for attachment of the external panel 46 to an underlying chassis support element 42 if present, via the pillar 100. Alternatively, other structure such as bracing 91 for the divider 90 between an oven-cavity section 92 and a storage-drawer section 94 can be affixed to the external panel(s) 46 via its (their) pillars 100 in a similar manner. Any suitable fastener can be used, and or an alternative method of coupling, such as welding, adhesive, etc. Each pillar 100 is configured to engage against the engaged structure (e.g. bracing 91, adjacent external panels 46 or underlying chassis support elements 42 if present) directly. Importantly, however, other than conventional fasteners such as screws or rivets, there is no intermediate bracing or bracket structure affixing the pillars 100 to any adjacent panels 46 or underlying chassis support elements 42 to which the pillars are mounted.

Turning briefly to FIG. 5B, the pillars 100 will be further described, referring to a single pillar 100, but applicable to any illustrated or non-illustrated pillar. The pillar 100 defines a columnar volume 106 that extends along and is partially enclosed by the inner side 84 of the main body portion 54, such as along a full vertical extent of the rear side 84. The columnar volume 106 is defined at least at a majority of its periphery by the interior body portion 80. The inner side 84 of the main body portion 54 also defines a periphery of the columnar volume 106 extending along the pillar central axis 104. The illustrated central volume 106 is empty but in other embodiments can be filled, such as by a foam, for example a heat resistant foam, or other suitable filler. Foams or other fillers can be used to provide additional structural robustness to the pillar 100; e.g. improving its stiffness or rigidity.

The inward terminal end of the interior body portion 80 of the panel 46, e.g. just beyond the side of the pillar 100 remote from the adjacent edge 90, can include a distal support end 116 providing a multi-layer thick section of the external panel 46 having two layers of the single sheet laid against one another (or optionally multi-layer—e.g. if multiple accordion-style layers are folded over one-to-the-next). That is, laterally inward of the sides of the pillar 100, a longitudinally extending distal support end 116 is provided, bent outward from the pillar 100 and extending towards the remote side edge 90 of the panel 46. This distal support end 116 provides a continuous section of structural support for the pillar 100 against the main body portion 54 along the full longitudinal and vertical height of the main body portion 54. In other embodiments, the distal support end 116 can extend along less than a full vertical height of the main body portion 54 and/or can be omitted.

Still looking to FIG. 5B, the illustrated pillars 100 each have a rectangular cross-section taken along a horizontal plane. In the illustrated embodiments, the pillars 100 also each have a constant shape along their full longitudinal lengths.

In other embodiments, however, various other shaped pillars can be formed, such as having a cross-section being cylindrical, elliptical, etc. In some embodiments, additional or different bends and folds in the interior body portion 80 can introduce additional or modified structural rigidity or support, for example tuned for a particular application or aligned in a particular location or direction, based on known or anticipated load transients for the appliance 10. In some embodiments, the columnar volume 106 and the pillar 100 can extend along less than a full vertical extent of the rear side 84. In some embodiments, a pillar can be formed having a non-constant shape along its full longitudinal length. In some embodiments two or more pillars of an external panel 46 can have different shapes and/or cross-sectional profiles as compared to one another.

Turning again to FIG. 6A, and also still to FIGS. 4, 5A and 5B, the interior body portion 80 further includes additional integral structural reinforcement 52 in the form of the at least one rearwardly bent flange 102 bent from a peripheral top or bottom edge 112, 114 of the external panel 46. The flange 102 is further turned downward to engage at least one pillar 100 of the pair of pillars 100. That is, the bent flange 102 extends from an edge 112, 114 of the external panel 46 that is transverse the lateral edge 90 from which the adjacent pillar 100 extends. The rearward and downward turning provides at least a partial box-flange extending laterally adjacent the upper edge 112.

As mentioned, the flange 102 is rearwardly turned and engages at least one pillar 100 at its first lateral edge, and preferably also engages the opposing pillar 100 at its opposed lateral edge, thereby forming a cooperative bracing structure such as a box brace between the opposed vertical pillars 100 and the lateral flange 102 extending horizontally therebetween adjacent the top or bottom edge 112, 114. The engagement provides enhanced rigidity and renders the external panel 46 materially self-supporting in both vertical and horizontal/lateral directions, while also introducing material structural and torsional stability and support to the appliance 10 as a whole, particularly from transient loads that may be experienced in transport.

As illustrated, the depicted external panel 46 includes a pair of flanges 102 extending inwardly towards a center of the inner side 84 of the main body portion 54, from opposed peripheral (in the illustrated embodiment, top and bottom) edges 112 and 114. That is, the external panel 46 preferably provides a pair of opposed rearwardly bent and parallelly extending box-flanges 102 each having opposing distal ends 120 configured to engage the opposing pillars 100.

The flanges 102 each at least partially define a horizontally extending columnar volume 103 (FIG. 6A) defined between the flange 102 and the inner side 84 of the main body portion 54. Similar to the columnar volumes 106, the illustrated volumes 103 are empty but in other embodiments can be filled, such as by a foam, for example a heat resistant foam, or other suitable filler.

As depicted, the flanges 102 extend generally horizontally, while the pillars 100 extend generally vertically, thereby defining a completed box-brace structure or box-frame, formed integrally with and as part of the otherwise decorative external panel 46. In other embodiments, alternate alignments can be suitable. For example, one or more of the flanges 102 can be aligned other than parallel to one another and/or orthogonal to the pillars 100, and/or one or more of the pillars 100 can be aligned other than parallel to one another and/or orthogonal to the pair of flanges 102. For example, a pair of pillars 100 can extend transversely to one another, and/or a pair of distal flange ends 120 can extend transversely to one another.

To provide a secure engagement of the pillars 100 with the flanges 102, the pillars 100 and flanges 102 can be laid onto one another, either directly or indirectly, and can be affixed to one another at the rear of the panel 46 to provide robust integral vertical and horizontal support for the panel 46. For example, any one or more suitable face portions or edges of each of the pillars 100 and flanges 102 can be affixed to one another, such as via welding, adhesives, and/or other suitable bonding method. Additionally or alternatively, fasteners can be used, such as rivets, screws, etc. This affixation can provide greater corner stability than conventional external panels lacking integrated structural reinforcement.

Figure 6B:
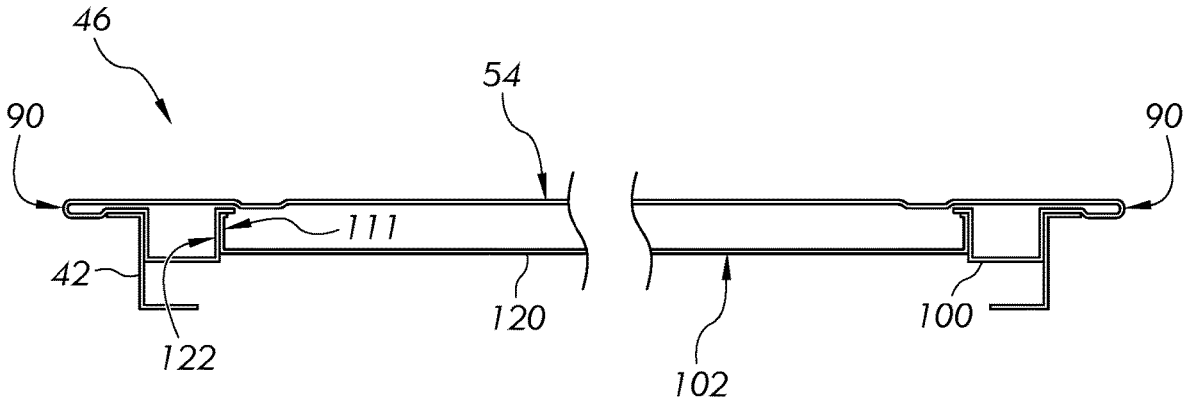
FIG. 6B illustrates a cross-sectional view of the external panel of FIG. 5A, shown at a line C-C of FIG. 5A

For example, as depicted at FIG. 5A, the distal end 120 of each illustrated flange 102 engages the inner lateral sides 122 of the adjacent pillar 100. Additionally, at least one flange 102 or at least one pillar 100 can overlay the other of the at least one flange 102 and the at least one pillar 100. For example, turning to FIGS. 6B (illustrating another horizontal cross-section of the panel 46, but along a flange 102) and 7, lateral side extensions 111 of the distal end 120 can be bent forward toward the inner side 84 (and toward the main body portion 54). The lateral side extensions 111 each have an outer face engaging the respective inner lateral side 122 of the respective pillar 100, which faces/sides can be affixed to one another, as mentioned above, by any suitable method.

Figure 7:
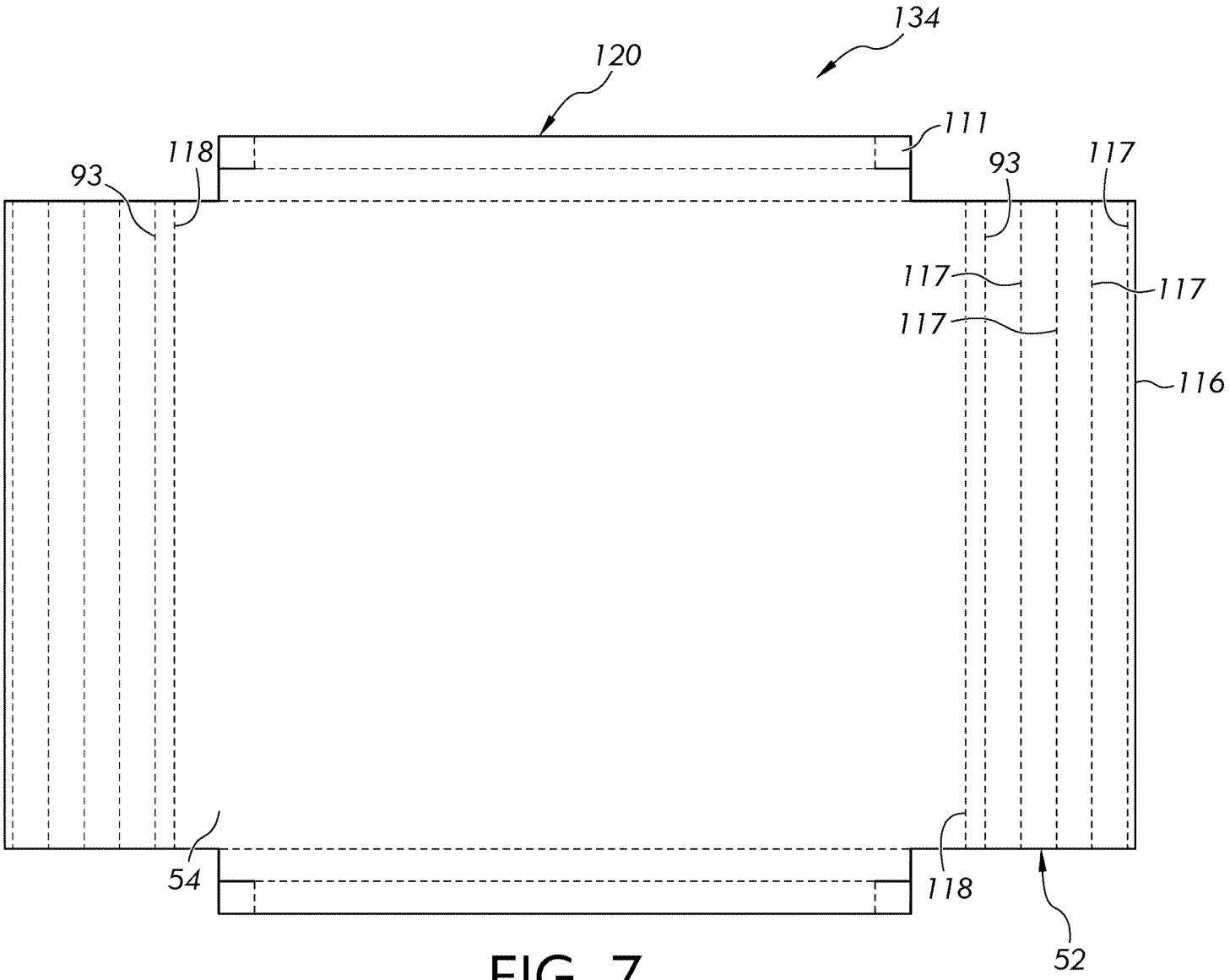
FIG. 7 illustrates a flat sheet profile of the external panel shown in FIG. 5A.

Turning now specifically to FIG. 7, depicted is a view of a single sheet 134 of unitary construction prior to being bent or folded to form the external panel 46 as described above. The section of the single sheet 134 forming the main body portion 54 is disposed centrally of the unfolded sheet 134. The side portions of the single sheet 134 that will form the opposing interior body portions 80 and the integral structural reinforcements 52 therein for the finished panel 46 (FIG. 5A) are disposed laterally of the main body portion 54, and terminate laterally at what will ultimately form the respective distal support ends 116. Imaginary apices 118 (which optionally can be provided as score marks if desired to facilitate easier bending) providing the apex of the U-shaped bends 92 (FIG. 5A) and the edges 90 (FIG. 5A) are illustrated in broken lines for reference. The crimp lines 93 and the bend lines 227 of the pillars 100 (FIG. 5A) also are illustrated in broken lines for reference (which also optionally can be provided as score marks if desired to facilitate easier bending). Extending vertically outwardly from the top and bottom of the unfolded single sheet are the sections that will form the opposed upper and lower flanges 102 (FIG. 5A). The distal ends 120 of these sections include the opposed side extensions 111 that are to be bent forwardly towards the main body portion 54.

In use, in some embodiments, two or more of the side external panels 46, and/or other panels including one or more of the aforedescribed integral features can be included in a respective cooking appliance at any suitable side of the cooking appliance, for example affixed to one another to define a reinforced chassis 42 for the appliance. In some embodiments the external panel 46 can be a rear or side external panel. An external panel 46 as disclosed herein also can be provided and used as a front external panel, having a central cutout in the main body portion 54 in register with the cooking cavity opening defined at the front of the oven muffle 14, over which the door 43 will open and close in order to provide access to the oven cavity 12. In some embodiments the external panel 46 can be affixed to underlying chassis support elements 42. Although pillars 100 are illustrated in the disclosed embodiments as running vertically, it also is possible that one or more panels 46 for an appliance is/are rotated 90 degrees, such that the pillars 100 thereof extend generally horizontally. In some embodiments multiple external panels can be included having integral features as aforedescribed, where at least one of the panels is aligned at a 90 degree rotation relative to at least one other panel.

In use after being formed by suitable bending or folding operations, the resultant illustrated external panel 46 has one or more of torsional rigidity, vertical and horizontal stiffness, impact deflection and compression resistance being greater than typical conventional external panels lacking integrated structural reinforcement. The folding or bending operations forming the external panel 46 enables precise pillars 100 and flanges 102 to be formed to provide unique support profiles to provide these structural properties. The external panel 46 also utilizes fewer parts and thus provides fewer elements in stackup tolerance to more closely control outer and thickness dimensions and mating surfaces of the end product. These effects combine to enable fabrication of an appliance utilizing the external panels 46 as its support chassis 42, as well as to aid efficient manufacturing of the end product, for example a three-dimensional structure or appliance, based on reduced part-count. Further, subsequent internal structure or feature redesign can include easier modification due to fewer parts to redesign.

Turning now to FIGS. 8A-8C, 9A-9E and 10, specific additional embodiments of external panels are depicted, each having one or more different integral features at a respective interior body portion thereof than the interior body portion 80 of the side external panel 46 that has been described to this point. Any of the external panels of the additional embodiments could be used with one another or with the side external panel 46 described above, and thus any of the external panels of the additional embodiments could be used with the cooking appliance 10 shown at FIGS. 1 and 4. The various embodiments of the external panels of FIGS. 8A-8C, 9A-9E and 10 are similar to the side external panel 46 described above, except as otherwise indicated. Aspects of any of the various embodiments of the external panels of FIGS. 8A-8C, 9A-9E and 10 can be combined with one another and/or with aspects of the side external panel 46 described above, where suitable.

Figure 8A:
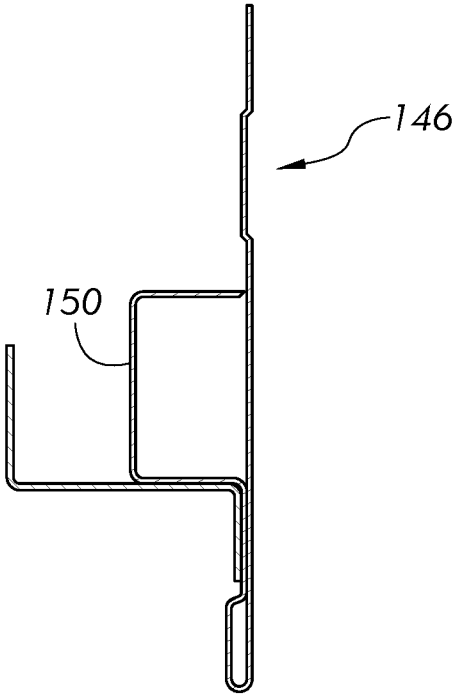
FIG. 8A illustrates a partial cross-sectional view of a further embodiment of an external panel of the cooking appliance taken along a portion of the line A-A of FIG. 5A adjacent to edge 90 thereof.
Figure 8B:
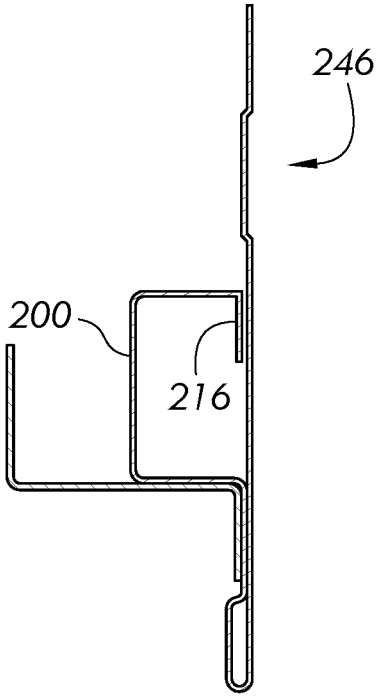
FIG. 8B illustrates a partial cross-sectional view of yet another embodiment of an external panel of the cooking appliance taken along a portion of the line A-A of FIG. 5A adjacent to edge 90 thereof.
Figure 8C:
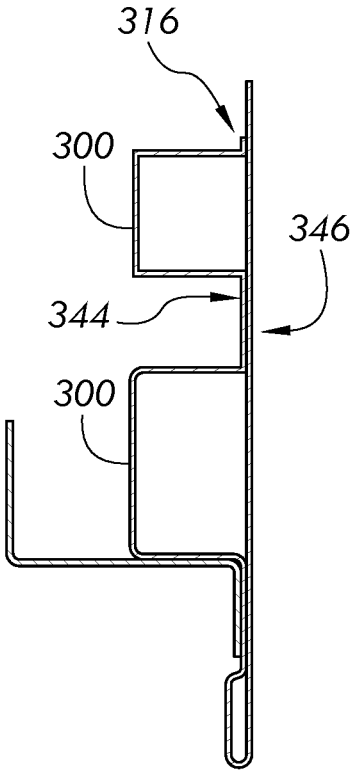
FIG. 8C illustrates a partial cross-sectional view of still another embodiment of an external panel of the cooking appliance taken along a portion of the line A-A of FIG. 5A adjacent to edge 90 thereof.

Looking first to FIGS. 8A-8C, each figure discloses a different pillar arrangement adjacent a side edge of the external panel 146. At FIG. 8A, a folded-over distal support end (numbered 116 with respect to the external panel 46) defining a further dual-layer structure with the main body portion (numbered 54 with respect to the external panel 46) is omitted from the respective pillar 150 of external panel 146. At FIG. 8B, the distal support end 216 of the external panel 246 is turned inwardly towards the respective pillar 200, so that it extends laterally outwardly towards the adjacent side edge 290. Similar to the pillar 100 shown at FIG. 6A, the pillar 200 of FIG. 8B provides a multi-layer thick section having a pair of layers of the single sheet laid against one another. Here, however, the multi-layer section extends a substantial width of the pillar itself, as opposed to adjacent the lateral edge of that pillar 200. In FIG. 8C the interior body portion of the external sheet 346 includes a pair of adjacent and parallel pillars 300 spaced form one another adjacent to a common edge 390 of the panel 346. Between the pillars 300 is an intermediate multi-layer thick section 344 having a pair of layers of the single sheet laid against one another. The most laterally-inward pillar 300 includes a distal support end 316 in the illustrated embodiment.

Figure 9A:
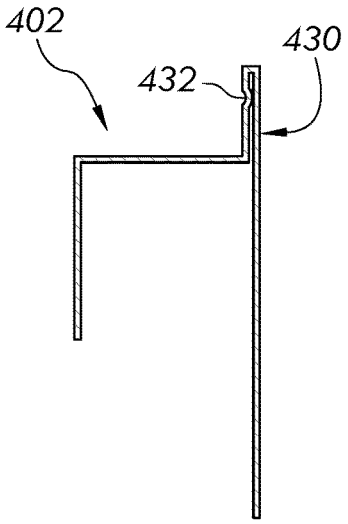
FIG. 9A illustrates a partial-cross sectional view of a further embodiment of an external panel, taken along a portion of the line B-B in FIG. 5A adjacent to edge 112 thereof.
Figure 9B:
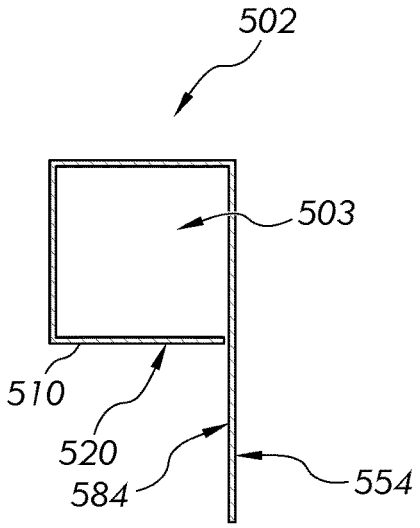
FIG. 9B illustrates a partial-cross sectional view of yet another embodiment of an external panel, taken along a portion of the line B-B in FIG. 5A adjacent to edge 112 thereof.
Figure 9C:
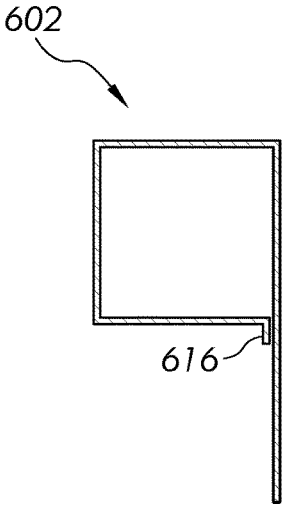
FIG. 9C illustrates a partial-cross sectional view of still another embodiment of an external panel, taken along a portion of the line B-B in FIG. 5A adjacent to edge 112 thereof.
Figure 9D:
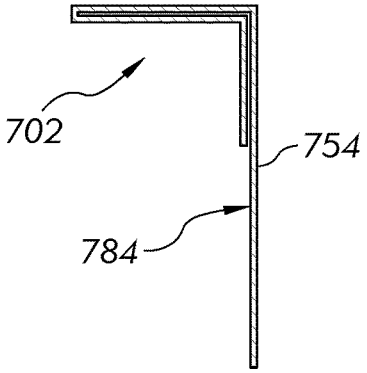
FIG. 9D illustrates a partial-cross sectional view still another embodiment of another external panel, taken along a portion of the line B-B in FIG. 5A adjacent to edge 112 thereof.
Figure 9E:
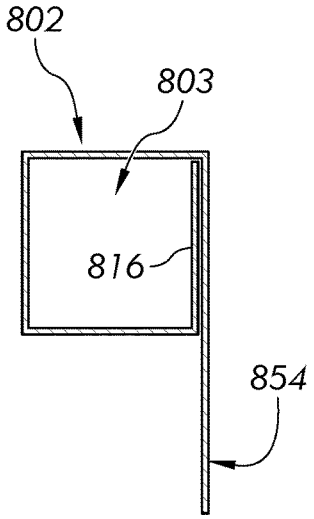
FIG. 9E illustrates a partial-cross sectional view of yet an even further external panel, taken along a portion of the line B-B in FIG. 5A adjacent to edge 112 thereof.

Turning next to FIGS. 9A-9E, each figure discloses a different flange arrangement extending from the upper peripheral edge of the respective external panel. FIG. 9A shows the flange 402 having a multi-layer thick section 430 and a crimp line 432 disposed vertically outwardly of the bent flange 402. FIG. 9B illustrates a box flange 502 having an additional inwardly/forwardly bent section 510 as compared to the flange 102 depicted at FIG. 6B. The flange 502 generally fully encloses a cross-section of the respective horizontally extending columnar volume 503. The section 510 at the distal end 520 of the flange 502 is directed towards the rear side 584 of the main body portion 554. FIG. 9C illustrates a similar box flange 602, but having a distal support end 616, similar to the distal support end 116 of the pillar 100 at FIG. 6A. FIG. 9D illustrates the flange 702 being bent back along and against itself and along and against the rear side 784 of the main body portion 754 instead of forming a horizontally extending columnar volume. That is, the flange 702 at FIG. 9D provides a multi-layer thick angle-iron section of a pair of layers of the single sheet laid upon one another. FIG. 9E depicts a flange 802 having a distal support end 816 being inwardly bent and upwardly directed into the columnar volume 803, fully enclosing a cross-section of the columnar volume 803 with the bent sections of the flange 802. Likewise, this distal support end 816 and the main body portion 854 provide a multi-layer thick section.

Figure 10:
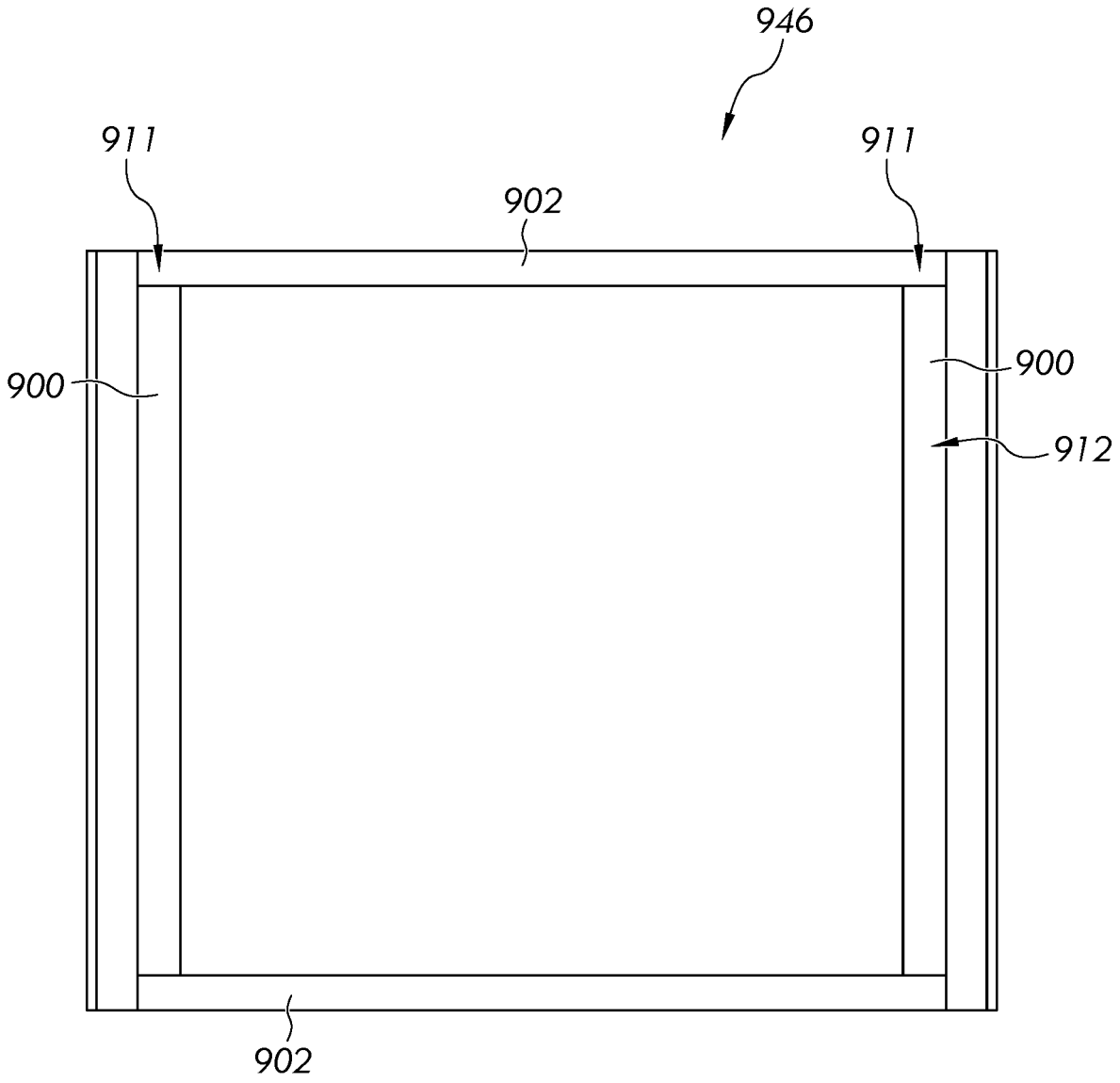
FIG. 10 illustrates a rear view (i.e. showing the interior body portion) of an exemplary external panel for use with the cooking appliance of FIG. 1.

Finally, turning to FIG. 10, a rear side of another external panel 946 is depicted. Different from the external panel 46 depicted at FIG. 5A, in this embodiment the pillars 900 do not extend the full height of the panel 946, whereas the opposing flanges 902 extend laterally over upper and lower vertical ends of the pillars 900 to form an alternative box-frame configuration. That is, the pillars 900 extend between interior faces of the flanges 102. This is opposite the construction in FIG. 5A, where the pillars 100 do extend the full height of the panel 46, with the flanges 102 there extending between interior faces of the opposing pillars 100.

In summary, in a preferred embodiment a household appliance 10 is provided having an oven cavity 12 defined by a muffle 14, a chassis 42 supporting the oven cavity 12 and formed of a plurality of decorative external panels 46 with integrated structural reinforcement 52, wherein at least one of the panels 46 provides an exterior face of the household appliance 10. The at least one panel 46 has a structure including a main body portion 54 and an interior body portion 80 integrally formed together from a common sheet of material, said interior body portion 80 comprising a plurality of integral structural reinforcements 52 formed from bending said sheet of material in said interior body portion 80 adjacent the main body portion 54. The integral structural reinforcements 52 include a pair of opposed parallelly extending pillars 100 each defining a columnar volume 106, and a pair of opposed rearwardly bent flanges 102 each being bent to engage the pair of pillars 100 to form a box frame adjacent to and integral with the main body portion 54.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

The invention claimed is:

1. A household appliance, comprising:

a decorative external panel providing reinforcement to said appliance, the decorative external panel comprising a main body portion and an interior body portion integrally formed together from a common sheet of material, said interior body portion comprising a first integral structural reinforcement formed from bending said sheet of material in said interior body portion, said common sheet of material being bent back over on itself via a first 180° bend to define a first lateral edge of said decorative external panel between the main body portion and a portion of said interior body portion aligned substantially parallel to the main body portion.

2. The household appliance of claim 1, said main body portion and said interior body portion at least partially intersecting at said first lateral edge, said first integral structural reinforcement comprising a first pillar formed integrally in and as part of said interior body portion and extending along said first lateral edge of said decorative external panel, the first pillar defining a first columnar volume.

3. The household appliance of claim 2, said decorative external panel further comprising an upper flange extending adjacent an upper peripheral edge thereof and being turned to engage the first pillar.

4. The household appliance of claim 3, said common sheet of material being bent back over on itself via a second 180° bend to define a second lateral edge of said decorative external panel, said main body portion and said interior body portion further intersecting at said second lateral edge, a second pillar formed integrally in and as part of said interior body portion and extending along said second lateral edge of said decorative external panel, the second pillar defining a second columnar volume, said upper flange further engaging said second pillar thereby partially defining a box frame from said first and second pillars and said upper flange.

5. The household appliance of claim 4, said decorative external panel further comprising a lower flange extending adjacent a lower peripheral edge thereof, and being turned to engage each of the first pillar and the second pillar, such that the interior body portion provides a box frame of integral structural reinforcement adjacent to and integral with the main body portion.

6. The household appliance of claim 4, the second lateral edge being disposed at an opposite lateral side of the decorative external panel as the first lateral edge.

7. The household appliance of claim 3, said decorative external panel further comprising a lower flange extending adjacent a lower peripheral edge thereof and being turned to engage the first pillar.

8. The household appliance of claim 3, wherein the upper flange defines a second columnar volume.

9. The household appliance of claim 3, wherein one of the upper flange or the first pillar overlays the other of the upper flange and the first pillar.

10. The household appliance of claim 2, further including a crimp line extending transverse the first lateral edge along the interior body portion and spaced between the first pillar and the first lateral bend.

11. The household appliance of claim 1, comprising a plurality of said decorative external panels that together at least partially define a chassis of the appliance.

12. The household appliance of claim 11, further including an oven cavity muffle supported by opposing ones of said decorative external panels that at least partially define said chassis.

13. The household appliance of claim 1, wherein the first integral structural reinforcement engages with an underlying chassis element absent any intermediate bracketry.

14. A decorative external panel at least partially defining a chassis of a household appliance, the decorative external panel comprising: a main body portion and an interior body portion integrally formed together from a common sheet of material, said common sheet of material being bent back over on itself via a 180° bend between the main body portion and a portion of said interior body portion aligned substantially parallel to the main body portion, said interior body portion comprising a first integral structural reinforcement formed from bending said sheet of material in said interior body portion to provide reinforcement to said appliance.

15. The decorative external panel of claim 14, further comprising a single lateral edge defined and formed by said single bend, said main body portion and said interior body portion at least partially intersecting at said single lateral edge, said first integral structural reinforcement comprising a first pillar formed integrally in and as part of said interior body portion and extending along said single lateral edge of said decorative external panel.

16. The decorative external panel of claim 15, further comprising an upper flange extending adjacent an upper peripheral edge thereof and being turned to engage the first pillar.

17. The decorative external panel of claim 16, wherein said first pillar and said upper flange each define a respective columnar volume.

18. The decorative external panel of claim 16, said common sheet of material being bent back over on itself via another single bend to define another single lateral edge between said main body portion and said interior body portion, a second pillar formed integrally in and as part of said interior body portion and extending along said another single lateral edge of said decorative external panel, the second pillar defining a second columnar volume, and a lower flange extending adjacent a lower peripheral edge thereof and being turned to engage each of the first pillar and the second pillar, such that the interior body portion provides a box frame of integral structural reinforcement adjacent to and integral with the main body portion.

19. The decorative external panel of claim 15, further including a crimp line extending transverse the single lateral edge along the interior body portion and spaced between the first pillar and the single bend.

20. A decorative external panel for a household appliance, the decorative external panel comprising: a main body portion and an interior body portion integrally formed together from a common sheet of material, said common sheet of material being bent back over on itself via a 180° bend to define a vertical edge of said decorative external panel between the main body portion and a portion of said interior body portion-aligned substantially parallel to the main body portion, said interior body portion comprising a plurality of integral structural reinforcements formed from bending said sheet of material in said interior body portion to provide reinforcement to said appliance, the plurality of integral structural reinforcements together forming a box frame of integral structural reinforcement adjacent to and integral with the main body portion, and the box frame defining a plurality of respective columnar volumes of the plurality of integral structural reinforcements.

* * * * *